United States Patent [19]

Chumney, Jr.

[11] Patent Number: 4,616,664

[45] Date of Patent: Oct. 14, 1986

[54] TOBACCO PRODUCT

[75] Inventor: Richard D. Chumney, Jr., Mechanicsville, Va.

[73] Assignee: American Brands, Inc., New York, N.Y.

[21] Appl. No.: 244,729

[22] Filed: Mar. 17, 1981

[51] Int. Cl.[4] ..... A24D 3/64

[52] U.S. Cl. ..... 131/336; 131/209; 131/339; 131/340; 131/361

[58] Field of Search ..... 131/331, 332, 336, 338, 131/339, 340, 341, 209, 361, 362

[56] References Cited

U.S. PATENT DOCUMENTS

| | | | |
|---|---|---|---|
| 1,718,122 | 6/1929 | DeShon | 131/336 |
| 1,926,564 | 9/1933 | Sharp . | |
| 3,324,862 | 6/1967 | De Simone . | |
| 3,390,684 | 7/1968 | Hudnell | 131/336 |
| 3,410,275 | 11/1968 | Tucker | 131/336 |
| 3,490,461 | 1/1970 | Osmalov et al. | 131/336 |
| 3,572,347 | 4/1971 | Sherrill | 131/336 |
| 3,607,512 | 9/1971 | Mathe | 131/340 |
| 3,608,561 | 9/1971 | Dock | 131/336 |
| 3,733,246 | 5/1973 | Thomson et al. . | |
| 3,910,288 | 10/1975 | Hammersmith et al. . | |
| 4,135,523 | 1/1979 | Luke et al. . | |
| 4,256,122 | 3/1981 | Johnson | 131/336 |

FOREIGN PATENT DOCUMENTS

| | | | |
|---|---|---|---|
| 2302677 | 10/1973 | Fed. Rep. of Germany | 131/339 |
| 2849904 | 3/1983 | Fed. Rep. of Germany . | |
| 55696 | 2/1950 | France . | |
| 1349992 | 12/1963 | France . | |
| 864247 | 3/1961 | United Kingdom . | |
| 2046573A | 11/1980 | United Kingdom . | |

*Primary Examiner*—Vincent Millin

*Attorney, Agent, or Firm*—Pennie & Edmonds

[57] ABSTRACT

A tobacco product such as a cigarette having a tobacco column within a combustible wrap and a filter plug located at one end of the tobacco column to filter constituents of the mainstream smoke. The filter plug is disposed within a layer of plug wrap which preferably is nonporous and an outer tipping wrap surrounds the plug wrap. A plurality of grooves or depressions formed along the filter plug provide for a secondary flow of air to the mouth of the smoker. An access opening communicating secondary air to each groove is defined by a plurality of perforations located in one or more rows or bands around the outer tipping paper. Depressions located along axes parallel to the axis of the filter member or disposed in a helical pattern may be used. In a second form of the invention, the access opening communicating secondary air to each groove is defined by an annular opening between individual portions of the outer tipping paper. In both forms of the invention the access opening is spaced away from the junction between the tobacco column and filter plug. The tobacco product has draw resistance lower than that typically found in conventional ventilated high filtration cigarettes.

29 Claims, 6 Drawing Figures

TOBACCO PRODUCT

DESCRIPTION

1. Technical Field

The invention is in a tobacco product. More particularly the invention relates to the combination of a cigarette, cigar, or similar smoker's article including a tobacco column within an outer wrap formed of a combustible material and a filter member mounted coaxially at one end of the tobacco column for filtering mainstream smoke as the tobacco product is burned. The invention also relates to the filter member.

2. Background Art

Tobacco products of the type considered herein including a filter member are known to the prior art. To this end, it has been known for many years that certain ingredients normally found in the mainstream smoke of a burning tobacco column may be filtered by means of a filter and filter material mounted at one end of the tobacco column. The filter, thus, provides a barrier to and means for decreasing those ingredients prior to entering the mouth of the user. It is also known in the prior art to provide a secondary flow of air, that is, a ventilating flow of air to the mainstream smoke thereby to achieve a measure of dilution of the mainstream smoke. The secondary flow of air for diluting the mainstream smoke, and at the same time providing a cooling effect, may enter the tobacco product through a plurality of perforations formed in and along the combustible wrap of the tobacco column. Also, the secondary flow may enter the tobacco product through a plurality of perforations located within the filter member. Prior art of the latter type include U.S. Pat. Nos. 3,596,663 to F. J. Schultz et al and 3,860,011 to V. Norman. Both the Norman and Schultz et al patents disclose a filter plug of filtering material, a layer of plug wrap around the filter plug and a plurality of perforations arranged in circumferential rows within the outer wrap of tipping paper. In Norman, the plug wrap is juxtaposed to the filtering material; while in Schultz et al the plug wrap is fluted in a corrugated fashion about the filter plug. Finally, whether the perforations are in the tobacco column, or whether the plug wrap is corrugated, the plug wrap is porous and the secondary air for purposes as described enters into and mixes with the mainstream smoke within the confines of the tobacco product.

The prior art also includes a form of tobacco product including a tobacco column and a filter member having a plurality of open paths for a secondary flow of air to move along the length of the filter member unimpeded by the filter material. Prior art representative of this type of tobacco product is U.S. Pat. No. 3,324,862 to B. De Simone. De Simone discloses several embodiments of a tobacco product including embodiments wherein the paths are within a plurality of tubes, such as tubes of paper, and an embodiment wherein the paths are along depressions formed in the filter member. De Simone discloses a plurality of four paths extending in a parallel family along the length of the filter member. The tubes either are attached to an outer surface of a paper wrapper comprising the paper wrapper for both the tobacco column and the filter member, or the tubes may be located within the filter member immediately below the paper wrapper. The depressions are formed along the length of the filter member and located similarly to the tubes of the last-mentioned form.

The De Simone tobacco product is considered to suffer from several problems and disadvantages, among which include the techniques of manufacture. To this end, De Simone describes a plurality of apertures, referring particularly to the embodiment wherein the paths are within the filter member, equal in number to the number of paths with each aperture providing communication for flow of ambient air to an air passage. The apertures are formed in the paper wrapper about the tobacco column and filter member and the individual air passages are located at the upstream end of a path. Thus, De Simone describes that a flow of ambient air enters an aperture and, thereafter, moves into and through an air passage and a path prior to entry into the mouth of the smoker. The problems reside in the manner of manufacture of the tobacco product wherein a filter member may be fabricated with internal tubes, as described, and also in the manner of alignment of components whereby an air passage is properly located with respect both to a path, whether the path be defined by a tube or depression, and an aperture to intercommunicate the flow of ambient air which is isolated from the mainstream smoke. To this end, as best as may be determined, in all forms of the De Simone tobacco product only ambient air communicates with a path.

DISCLOSURE OF THE INVENTION

The present invention is directed to a tobacco product including cigarettes, cigars and similar smoking articles having a tobacco column supported by an outer combustible wrap and a filter member of a design whereby free and controllable levels of flow of ambient air, comprising a secondary or ventilating flow, may be drawn into the mouth of the smoker. The tobacco product and particularly the design of the filter member serves to provide decreased resistance to draw, and permits the achievement of an acceptable balance in today's marketplace between smoke yield and smoke taste.

The particular design of the filter member is such that a ventilating flow of ambient air enters into individual depressions, as will be described more fully, extending the full length of the filter member thereby to mix with, dilute and cool a portion of the mainstream smoke which shall have entered a depression at the upstream end, and to mix with, dilute and cool the remainder of the mainstream smoke within the mouth of the smoker.

The tobacco product and particularly the filter member of the present invention provides a unique means for controlling "tar" delivery to the smoker by use of a combination of ventilation and filtration. Smoke delivery is achieved at a lower draw resistance than usually found in prior art cigarettes of the so-called ventilated variety and by extending the depressions for flow of ambient air the entire length of the filter member the techniques of manufacture are greatly simplified and facilitated. Further, the coning effect typical of highly ventilated filter cigarettes is reduced or substantially eliminated by the filter member of the present invention. Overall the filter member is of a construction suitable for use in the fabrication of cigarettes in accordance with generally recognized manufacturing procedures, as well as with apparatus for that purpose.

According to the invention, a filter member for a tobacco product or the like comprises a body of filter material having a first end adapted to be placed in the mouth of the user and a second end adapted to be disposed coaxially at one end of the column of the tobacco product or the like. An inner wrap of an essentially nonporous sheet material, such as plug wrap, serves to maintain integrity of the filter material in rod-like form and a wrap of nonporous sheet material, such as tipping paper, forms an outer wrap. The outer wrap serves a primary function of connection of the filter member and tobacco column, and, additionally provides or ensures release from the lips of the user. One or more depressions are formed in the inner wrap extending from the first to the second end of the filter member. Finally, means are provided for ingress of a secondary flow of ambient air into a depression for purposes as heretofore described.

Several forms of filter member are contemplated within the scope of the present invention. For example one or more depressions may be formed in the inner wrap arranged as a family either of rectilinear or non-rectilinear depressions, such as depressions following a helical pattern. Preferably, however, a plurality of four (4) rectilinear depressions are formed in the inner wrap. While the depressions need not be equidistantly spaced apart around the circumference, an equidistant spacing is preferred.

The means providing an ingress of flow of ambient air to an individual depression may take the form of a plurality of perforations arranged in one or more rows of perforations in the outer wrap, and the invention envisions that the outer wrap may comprise a first and second wrap, each extending from one end of the filter toward the other, yet terminating to provide an annular opening between the ends.

Preferably, each depression has an opening of about 1 to 2 mm and a depth of about 1 to about 2 mm. Variation in the size of the annular opening, that is the width dimension, and in the number, size and location of perforations in one or more rings will serve to control the ingress of ambient air to a depression and, accordingly, the percent ventilation.

BEST MODE FOR CARRYING OUT THE INVENTION

Figure 1:
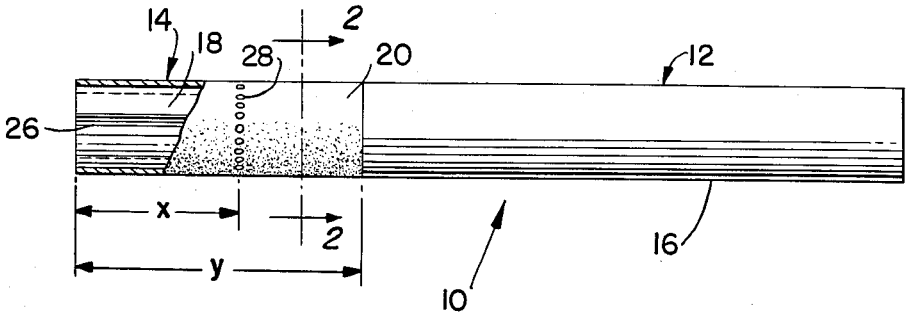
FIG. 1 is a view in elevation, partially broken away, of a tobacco product and filter member of the present invention.

Referring to FIG. 1, there is illustrated a tobacco product 10 including a tobacco column 12 and a filter member 14 mounted at one end of the column. The tobacco product overall is of rod-like configuration and of any length as may be conventional in the industry. Typically, the tobacco product may be 70 to 120 mm in length.

A combustible wrap 16 supports the column of tobacco throughout its length and a plug wrap 18 encases the filter member.

Figure 4:
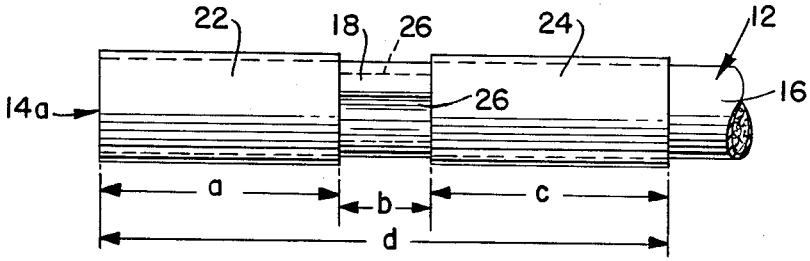
FIG. 4 is a view similar to FIG. 1, although only a partial view, of a tobacco product and a further form of filter member of the present invention.

The filter member is defined by a body of filter material which may be any one of cellulose acetate, paper, a polyolefin, a polyurethane or other polymeric foam of an open cell variety or other commonly used filter material. Preferably, however, the filter material is cellulose acetate and, through the manufacturing process, typically is characterized by its capability of self-support in the rod-like configuration. An outer wrap 20 of tipping paper (see FIG. 1) or a pair of outer wraps 22, 24, spaced apart along the filter member, (see FIG. 4) surround the plug wrap. The outer wrap of tipping paper, referring to the form of the invention of FIG. 1, serves the functions of connecting the tobacco column and filter member and of ensuring lip release for the smoker. These functions are provided by the individual outer wraps 24, 22 of tipping paper, respectively, of the form of the invention of FIG. 4. The filter member illustrated in FIG. 4 is denoted by the numeral "14*a*".

According to the invention, plug wrap 18 is formed either of nonporous paper or paper having a porosity value which closely approaches that of a paper considered as nonporous. To this end, as will be described, the secondary air flow providing ventilation is to enter the mouth of the smoker and mix with the mainstream smoke through a flow path or paths isolated or substantially isolated from the body of filter material. There will be a degree of mixing within each flow path, also.

Turning to FIG. 1, a plurality of grooves or depressions 26 are formed in the filter member, each depression extending throughout the entire length (y) of the filter member. The manner and means of formation of each depression and the point in time during the overall process of manufacture of the filter rod, or the point in time following the cutting of filter rod into individual filter units, which may be of double or greater length, is outside the scope of the present invention.

Figure 2:
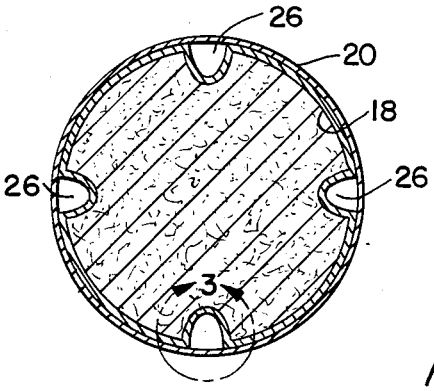
FIG. 2 is an enlarged view in cross section of the filter member as seen along the line 2—2 in FIG. 1.
Figure 3:
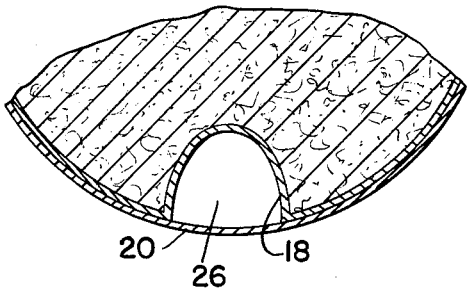
FIG. 3 is a further enlargement of a portion of the illustration of FIG. 2.
Figure 5:
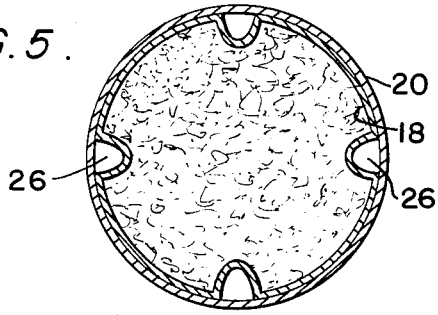
FIG. 5 is a view similar to FIG. 2 although illustrating a slight modification.

The invention envisions the formation of at least one (1) depression along the filter member, and preferably a plurality of two (2) or more depressions. Each depression may have an axis, as perhaps best seen in FIGS. 2, 3 and 5, extending parallel to the axis of the filter member, and it is envisioned that each depression may follow a non-rectilinear path from one end of the filter member to the other end. For example, each depression may follow a helical path, see FIG. 6. Further, each depression, if more than one (1) depression is formed in the filter member, may be spaced equidistantly from other depressions around the circumference of the filter member, although such spacing is not required. Further still, each depression provides an outer opening and side surfaces which converge together. If, as previously discussed, the plug wrap 18 is nonporous or substantially nonporous, the flow path within the open area of each depression will be isolated or substantially isolated from the filter material.

In the form of the invention of FIG. 1, a plurality of perforations 28 are formed in the outer wrap 20. The perforations are located around the circumference of the outer wrap and may be arranged in any particular pattern, for example, in one or more rings. Preferably, each perforation of each ring is spaced equidistantly from adjacent perforations in that ring. The perforations may be provided mechanically, electrostatically, by means of a laser process, by a combination of these processes and others as may be conventional.

The percentage of ventilation of the tobacco product 10 depends upon many factors, for example, the area of each peforation 28, the porosity of plug wrap 18, the number of depressions 26, the size of a depression, the number of perforations that align with a depression, and the location of the ring or rings of perforations relative to the end of the filter member 14 removed from the tobacco column 12. Typically, having a filter member of a length of 25 mm (y), the rows of perforation will reside at a distance of from about 10 mm to about 20 mm (x) from the mouth end of the filter member. The area of a perforation may vary in range depending on the manner of formation from about 0.001 $mm^2$ to about 0.50 $mm^2$. The plug wrap preferably is nonporous. The number of depressions will range from two (2) to eight (8) and preferably four (4). Each depression will have an opening of about 1 to about 2 mm and a depth of about 1 to 2 mm. And, the outer wrap 20 may be in the form of air permeable tipping.

Conventional low "tar" (equivalent to dry particulate matter, DPM) cigarettes are typically made using a cellulose acetate tow which is capable of high filtration efficiencies; however such filters inherently increase resistance to draw (pressure drop), causing an adverse smoker reaction. The following data demonstrate that for a given "tar" delivery, filter and total cigarette pressure drop may be significantly decreased by using the filter member of this invention. A comparison may be drawn from Examples 1 and 2, both of which describe 85 mm cigarettes (a first pair), and a comparison may be drawn from Examples 3 and 4, both of which describe 100 mm cigarettes (a second pair).

EXAMPLE 1

The filter member of this invention was constructed using 3.3 denier per filament, 44,000 total denier, "Y" cross-section cellulose acetate filter tow wrapped with nonporous plug wrap. The filter plug had four depressions spaced 90 degrees apart, running the full length of each filter plug. The filter plug was attached to the tobacco column using tipping paper containing two rows of laser-imparted perforations.

EXAMPLE 2

In the construction of a conventional commercial low "tar" cigarette, the filter was made from 2.1 denier per filament, 48,000 total denier, "Y" cross-section cellulose acetate tow wrapped with porous plug wrap having a permeability of 26,000 CORESTA units. The filter plug was attached to the tobacco column using tipping paper containing two rows of laser-imparted perforations.

Physical properties and smoke analyses for cigarettes made according to Examples 1 and 2 are shown below:

| | Example 1 | Example 2 |
|---|---|---|
| Cigarette Length (mm) | 85 | 85 |
| Pressure Drop | | |
| Total Cigt. (cm) | 4.4 | 12.4 |
| Filter Tip (cm) | 3.6 | 10.5 |
| Ventilation (%) | 79 | 74 |
| Length Smoked (mm) | 48 | 48 |
| Yield of DPM (mg/cigt) | 1.03 | 1.06 |
| Yield of Nicotine (mg/cigt) | 0.13 | 0.13 |

EXAMPLE 3

Another filter member of this invention was constructed using 3.3 denier per filament, 44,000 total denier, "Y" cross-section cellulose acetate filter tow wrapped with nonporous plug wrap. The filter plug had four depressions spaced 90 degrees apart running the full length of each filter plug. The filter plug was attached to the tobacco column using tipping paper containing two rows of laser-imparted perforations.

EXAMPLE 4

In the construction of a second conventional commercial low "tar" cigarette, the filter was made from 3.4 denier per filament, 46,000 total denier, "I" cross-section cellulose acetate tow wrapped with porous plug wrap having a permeability of 6,500 CORESTA units. The filter plug was attached to the tobacco column using tipping paper containing two rows of laser-imparted perforations.

Physical properties and smoke analyses for cigarettes made according to Examples 3 and 4 are shown below:

| | Example 3 | Example 4 |
|---|---|---|
| Cigarette Length (mm) | 100 | 100 |
| Pressure Drop | | |
| Total Cigt. (cm) | 7.1 | 12.7 |
| Filter Tip (cm) | 5.3 | 10.2 |
| Ventilation (%) | 59 | 52 |
| Length Smoked (mm) | 65 | 65 |
| Yield of DPM (mg/cigt) | 5.6 | 5.5 |
| Yield of Nicotine (mg/cigt) | 0.59 | 0.49 |

These examples are considered to provide concrete evidence that the tobacco product herein disclosed has a lower draw resistance than conventional ventilated filter cigarettes of comparable "tar" and nicotine yield. It is well-known that the consumer reaction to this improvement is entirely positive. Further, the filter cigarette of this invention, in any one of the forms disclosed, may be readily manufactured on high speed production equipment known to those practiced in the art.

Referring to FIG. 4, there is illustrated a filter member **14*a* of a second form of the invention. The filter member, likewise, is mounted at the end of tobacco column 12 and as previously discussed, a pair of outer wraps 22, 24 encase a layer of plug wrap 18. Outer wrap 24 serves primarily to connect the filter member and tobacco column, while the outer wrap 22 serves as a mouthpiece, improves roundness and feel, and further provides a means for ensuring acceptable lip release. More importantly, the use of two outer wraps separated by an annular space, which may be varied in width, provides a further means for controlling the ingress of ambient air into a depression 26, and accordingly will serve to obviate the necessity of using a perforated outer wrap. The annular space between the outer wraps 22, 24** may be in the range of about 2 to about 10 mm.

The filter member, aside from the individual outer wraps, may be considered like the filter member 14. To this end, the overall length of filter member **14*a*, length d, may be about 20 to about 40 mm and the length c may be any length sufficient to connect the tobacco column 12 and the filter member 14*a***.

Figure 6:
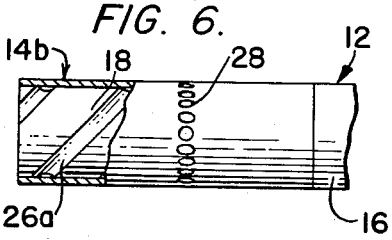
FIG. 6 is a view similar to FIG. 1 illustrating yet a further form of filter member of the present invention.

Referring to FIG. 6, there is illustrated a filter member **14*b* of a third form of the invention. The filter member, likewise, is mounted at the end of tobacco column 12 and differs from the form of the invention first-described only in that each depression 26*a*** follows a helical path from one end of the filter member to the other.

I claim:

1. A filter for a tobacco product and the like comprising (a) a body of filter material of overall cylindrical rod-like configuration extending between a first end adapted to enter the mouth of the user and a second end adapted to be disposed both juxtaposed to and coaxially with a column of tobacco, (b) means for maintaining said filter material in said configuration, said maintenance means including a first wrap of substantially nonporous sheet material forming an inner wrap, (c) at least one depression formed in said inner wrap providing an unimpeded flow path along the full length of said body for passing a portion of the mainstream smoke to said first end and into the mouth of the user, said flow path being isolated from said filter material, (d) a second wrap of sheet material forming an outer wrap to surround said inner wrap and each said flow path, said outer wrap being substantially nonporous, and (e) means for ingress of ambient air to each said flow path whereby air may mix and commingle with said portion of mainstream smoke thereby to dilute and cool said portion within said flow path, said ingress means formed in said outer wrap between said first and second ends of said body.

2. The filter of claim 1 including a plurality of depressions formed in said inner wrap.

3. The filter of claim 1 or 2 wherein each said depression extends rectilinearly along said body.

4. The filter of claim 1 or 2 wherein each said depression extends non-rectilinearly along said body.

5. The filter of claim 4 wherein each said depression follows a helical path.

6. The filter of claim 2 wherein each said depression is spaced equidistantly from an adjacent depression measured circumferentially in either direction about said body.

7. The filter of claim 6 including a plurality of four depressions.

8. The filter of claim 1 or 2 wherein each said depression includes an opening of from about 1 to 2 mm and a depth of from about 1 to 2 mm.

9. The filter of claim 1 or 2 wherein said ingress means is formed by a plurality of perforations, equally spaced circumferentially, and disposed in at least one row of perforations about said outer wrap.

10. The filter of claim 9 wherein said perforations are arranged in two rows.

11. The filter of claim 10 wherein said body of filter material is about 25 mm in length, and wherein each said row of perforations is disposed from about 10 to about 20 mm from said first end.

12. The filter of claim 1 wherein said inner and outer wraps are paper and said filter material is cellulose acetate tow.

13. A tobacco product or the like comprising (a) a tobacco column, (b) a wrap for said tobacco column, (c) a filter means for filtering mainstream smoke from said tobacco column, said filter means comprising (1) a body of filter material of overall cylindrical rod-like outline extending between a first end adapted to enter the mouth of the user and a second end adapted to be disposed both juxtaposed to and coaxially with a column of tobacco, (2) means for maintaining said filter material in said outline, which outline is substantially concentric to that of said tobacco column, said maintenance means including a first wrap of substantially nonporous sheet material forming an inner wrap, (3) at least one depression formed in said inner wrap providing an unimpeded flow path along the full length of said body for passing a portion of the mainstream smoke to said first end and into the mouth of the user, said flow path being isolated from said filter material, (4) a second wrap of sheet material forming an outer wrap to surround said inner wrap and each said flow path, said outer wrap being substantially nonporous, and (5) means for ingress of ambient air to each said flow path whereby said air may mix and commingle with said portion of mainstream smoke thereby to dilute and cool said portion within said flow path, said ingress means formed in said outer wrap between said first and second ends of said body, and said outer wrap serving to connect said body of filter material to said tobacco column.

14. The filter of claim 13 including a plurality of depressions formed in said inner wrap.

15. The filter of claim 13 or 14 wherein each said depression extends rectilinearly along said body.

16. The filter of claim 13 or 14 wherein each said depression extends non-rectilinearly along said body.

17. The filter of claim 16 wherein each said depression follows a helical path.

18. The filter of claim 14 wherein each said depression is spaced equidistantly from an adjacent depression measured circumferentially in either direction about said body.

19. The filter of claim 18 including a plurality of four depressions.

20. The filter of claim 13 or 14 wherein each said depression includes an opening of from about 1 to 2 mm and a depth of from about 1 to 2 mm.

21. The filter of claim 13 or 14 wherein said ingress means is formed by a plurality of perforations, equally spaced circumferentially, and disposed in at least one row of perforations about said outer wrap.

22. The filter of claim 21 wherein said perforations are arranged in two rows.

23. The filter of claim 22 wherein said body of filter material is about 25 mm in length, and wherein each said row of perforations is disposed from about 10 to about 20 mm from said first end.

24. The filter of claim 13 wherein said inner and outer wraps are paper and said filter material is cellulose acetate tow.

25. A smoke filter including a filter element comprising:

(a) a smoke pervious filter rod having first and second longitudinally spaced ends;

(b) smoke-impervious rod wrap means wrapped about said filter rod, said rod wrap means being recessed into said filter rod to define at least one continuous grooved portion of said rod wrap means extending from said first end to said second end; and (c) tipping means disposed about said rod wrap means to cover said grooved portion, said tipping means being made of material which is impervious to smoke, said tipping means including ventilation means for providing gas flow communication between said grooved portion and ambient air.

26. A filtered cigarette comprising, in combination, a tobacco rod and a filter means secured in end-to-end relationship to one end of said tobacco rod, said filter means including a filter element as defined in claim 25.

27. A smoke filter for a tobacco product including a filter element comprising:

(a) a smoke pervious filter rod having first and second longitudinally spaced ends, one of said ends being adapted to be connected to said tobacco product;

(b) smoke-impervious rod wrap means wrapped about said filter rod, said rod wrap means being recessed into said filter rod to define at least one continuous grooved portion of said rod wrap means extending from said first end to said second end whereby a portion of smoke from said tobacco product may enter said continuous grooved portion and move from said one end toward said other end of said filter rod; and (c) tipping means disposed about said rod wrap means to cover said grooved portion, said tipping means being made of material which is impervious to smoke, said tipping means including ventilation means for providing gas flow communication between said grooved portion and ambient air.

28. A smoke filter for a tobacco product including a filter element comprising:

(a) a smoke pervious filter rod having first and second longitudinally spaced ends, one of said ends being adapted to be connected to said tobacco product;

(b) smoke-impervious rod wrap means wrapped about said filter rod, said rod wrap means being recessed into said filter rod to define at least one continuous grooved portion of said rod wrap means extending from said first end to said second end whereby a portion of smoke from said tobacco product enters said continuous grooved portion and moves from said one end toward said other end of said filter rod; and (c) tipping means disposed about said rod wrap means to cover said grooved portion, said tipping means being made of material which is impervious to smoke, said tipping means including ventilation means for providing gas flow communication between said grooved portion and ambient air whereby said ambient air mixes and commingles with said portion of smoke from said tobacco product entering said continuous grooved portion.

29. A filtered cigarette comprising, in combination, a tobacco rod and a smoke filter secured in end-to-end relationship to one end of said tobacco product, said smoke filter including a filter element as defined in claim 28.

* * * * *